United States Patent [19]

Nhaissi

[11] Patent Number: 5,056,337

[45] Date of Patent: Oct. 15, 1991

[54] DIAMOND SETTING

[75] Inventor: Eric Nhaissi, New York, N.Y.

[73] Assignee: Pan American Diamond Corporation, New York, N.Y.

[21] Appl. No.: 536,013

[22] Filed: Jun. 4, 1990

Related U.S. Application Data

[63] Continuation of Ser. No. 238,557, Aug. 30, 1988, abandoned.

[51] Int. Cl.[5] ..... A44C 17/02

[52] U.S. Cl. ..... 63/26; 63/27

[58] Field of Search ..... 63/26, 27, 28, 30

[56] References Cited

U.S. PATENT DOCUMENTS

| | | | |
|---|---|---|---|
| 1,368,909 | 2/1921 | Eliasoff et al. | 63/27 |
| 2,273,227 | 2/1942 | Simmons | 63/26 |

FOREIGN PATENT DOCUMENTS

| | | | |
|---|---|---|---|
| 1505450 | 12/1967 | France | 63/26 |
| 2026303 | 2/1980 | United Kingdom | 63/26 |
| 2079140 | 1/1982 | United Kingdom | 63/26 |
| 2084855 | 4/1982 | United Kingdom | 62/26 |

*Primary Examiner*—Laurie K. Cranmer

*Attorney, Agent, or Firm*—Amster, Rothstein & Ebenstein

[57] ABSTRACT

A generally round setting for a diamond, which simulates the appearance of a larger diamond, comprises an annulus and three prongs. The annulus has an upper surface stamped with from nine to twenty-one equally spaced apart, radially extending cuts providing reflecting surfaces, each of the cuts being wedge shaped in plan and V-shaped in cross section. The three equally spaced apart prongs are upstanding from the annulus upper surface for receiving and holding the diamond.

13 Claims, 1 Drawing Sheet

FIG.1
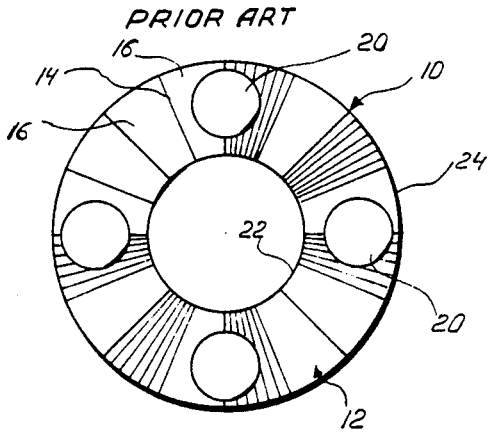
FIG.2
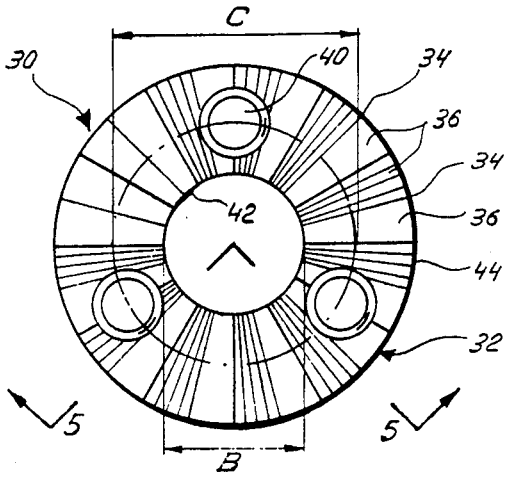
FIG.5
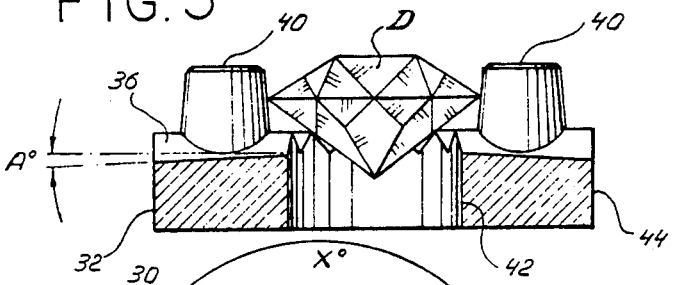
FIG.3
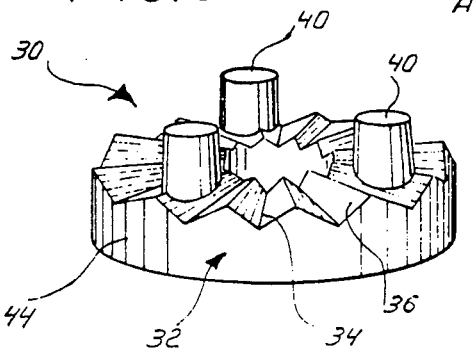
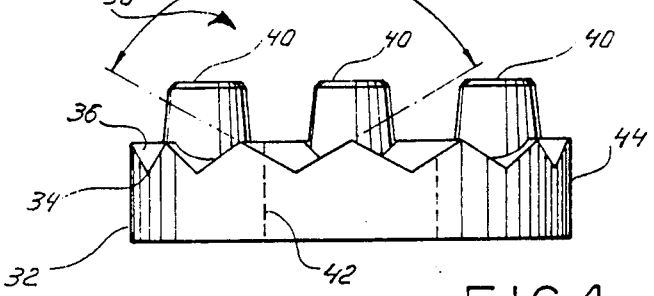
FIG.4
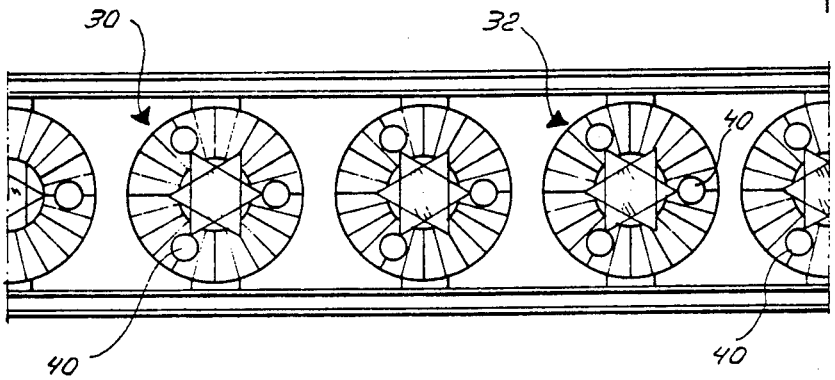
FIG.6

DIAMOND SETTING

This is a continuation of co-pending application Ser. No. 238,557 filed on Aug. 30, 1988, now abandoned.

BACKGROUND OF THE INVENTION

The present invention relates to a diamond setting and more particularly to a generally round setting for a diamond which simulates the appearance of a larger diamond.

There exists a variety of different settings for a diamond which show the diamond to its best advantage and hopefully simulate the appearance of a larger diamond. A popular setting of this type is the generally round "miracle" setting comprising an annulus and four prongs, all made of white gold. The annulus has an upper surface stamped or diamond cut with eight equally spaced apart, radially extending cuts providing reflecting surfaces. Each of the cuts is wedge shaped in plan and V-shaped in cross-section. The walls of each of the cuts extend at an angle of 120° and meet in a smooth curve. The four equally spaced apart prongs are upstanding from the annulus upper surface for receiving and holding the diamond. They are substantially spaced from the inner surface of the annulus and almost in contact with the outer surface of the annulus. The cuts provide reflecting surfaces surrounding the actual diamond so that the actual diamond appears to be the table or upper central portion of a much larger diamond with the annulus appearing to be the round or surrounding portion of a much larger diamond.

The "miracle" setting, despite its wide use and acceptability, has not proven to be entirely satisfactory; there is always a need for a setting which will simulate the appearance of an even larger diamond.

Accordingly, it is an object of the present invention to provide a "miracle" type setting which simulates for a diamond the appearance of an even larger diamond than that normally simulated by a conventional "miracle" setting.

SUMMARY OF THE INVENTION

It has now been found that the above and related objects of the present invention are obtained in a generally round setting for a diamond which simulates the appearance of a larger diamond. The setting comprises an annulus and three prongs. The annulus has an upper surface stamped with from at least nine (and preferably 9 to 21) equally spaced apart, radially extending cuts providing reflecting surfaces, each of the cuts being wedge shaped in plan and V-shaped in cross section. The three equally spaced apart prongs are upstanding from the annulus upper surface for receiving and holding the diamond.

In a preferred embodiment, the annulus has 12 to 21 (preferably 12) of the cuts, the walls of each of the cuts meeting sharply at an angle of approximately 120°. From the outer surface of the annulus inwardly towards the inner surface of the annulus, the cuts are inclined upwardly at approximately 5.0–8.5° to the horizontal, thereby becoming shallower nearer the center of the diamond. For an annulus having N of the cuts, each inclined upwardly at an angle of A° from the outer surface to the inner surface of said annulus and having walls forming an angle of X°, $$A=[(360/N)/2]\times tan[(180-X)/2]$$

Where X is 120°, $A=(360/2N)\times \tan 30$.

Preferably the prongs are closer to the inner surface of the annulus than the outer surface and are spaced apart from each other along an imaginary circle of diameter C about the inner surface B of said annulus, according to the formula:

$$C=B/0.6.$$

The setting is preferably formed of white gold.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 1 is a top plan view of a prior art miracle setting;

FIG. 2 is a top plan view of the improved "miracle" setting according to the present invention;

FIG. 3 is an isometric view of the setting of FIG. 2;

FIG. 4 is a side elevation view of the setting of FIG. 2;

FIG. 5 is a side elevation view of the setting of FIG. 2 with a diamond therein, partially in cross-section, taken along the line 5—5 of FIG. 2 and looking in the direction of the arrows; and FIG. 6 is a top plan view of a series of settings (with diamonds therein) in sequence, as might be found on a bracelet.

DETAILED DESCRIPTION OF THE PREFERRED EMBODIMENTS

Referring now to the drawing, and in particular to FIG. 1 thereof, therein illustrated is a prior art "miracle" setting generally designated by the reference numeral 10. The generally round setting comprises an annulus generally designated 12 having an upper surface stamped or diamond cut with eight equally spaced apart, radially extending cuts 14 defining reflecting surfaces. Each of the cuts 14 is wedge shaped in plan and V-shaped in cross section, with no lands separating adjacent cuts 14. The walls 16 of each cut 14 approach together at an angle of 120°, forming a rounded vertex. There are four equally spaced apart prongs 20 upstanding from the annulus upper surface for receiving and holding a diamond in the center of the setting. The prongs are substantially and equidistantly spaced from the inner surface 22 of the annulus 12 and are closely adjacent to the outer surface 24 of the annulus 12.

Referring now to FIGS. 2–6, it has been found that an enhanced "miracle" effect—that is, the simulation of the appearance of an even larger diamond—is obtained by modifying the number and placement of the prongs as well as the number and configuration of the cuts. More particularly, the improved "miracle" setting of the present invention, generally designated 30, comprises an annulus generally designated 32 having an upper surface stamped with at least 9 equally spaced apart, radially extending cuts 34 providing light reflecting surfaces. Each cut 34 is defined by two side walls 36. Where more than twenty-one cuts 34 are used, the cuts 34 must be so shallow that the light reflecting property of the cuts 34 is reduced. Generally, the greater the diameter of the opening 42 of the annulus 32 (and this typically varies with the size of the diamond), the more cuts 34 can be used without the cuts becoming too shallow to produce the desired optical effect. As the setting 30 is intended for use with small diamonds up to 1 carat (preferably 0.5–10.0 points) 9 to 21 cuts 34 are generally preferred depending on the diamond size. Twelve cuts 34, as shown, are especially preferred for diamonds of up to 3 points; 15 cuts, for diamonds of 4 points; 21 cuts, for diamonds of 10 points. Each of the cuts 34 is wedge shaped in plan (see FIGS. 2 and 3) and V-shaped in cross section (see FIGS. 3 and 4). The two walls 36 of each cut 34 preferably approach at an angle of approximately 120°, meeting sharply at a well defined, sharp vertex.

The setting 30 further includes three equally spaced apart prongs 40 upstanding from the annulus upper surface. The prongs 40 are truncated cones, preferably truncated cones having an inward and upward taper of about 5° and a diameter at the top of about 0.015 inches, as shown. The prongs 40 are closer to the inner surface or opening 42 of the annulus 32. The placement of the prongs 40 more closely adjacent the inner surface or opening 42 of the annulus 32 permits a wide border of cuts adjacent the annulus outer surface 44 to be reflectively operative. A preferred disposition of the prongs is along an imaginary circle of diameter C about the inner annulus surface 42 of diameter B, where C is determined by the formula:

$$C=B/0.6$$

As best seen in FIG. 3, from the outer surface of the annulus 32 towards the inner surface or opening 42 of the annulus 32, the cuts 34 are inclined upwardly at a slight angle, preferably from about 5.0° to 8.5° to the horizontal, so that the cuts 34 become shallower as they approach the center of the diamond D (see FIG. 5). Where the annulus 32 has N cuts have walls 36 forming an angle of X°, the formula for the preferred angle of inclination A is:

$$A=[(360/N)/2]\times \tan\,[(120-X)/2]$$

For cuts having walls 36 forming an angle X of 120°, the preferred angle of inclination A is determined by the formula:

$$A=[(360/N)/2]\times \tan\,30°=104/N$$

The angle A ranges from about 8.5° for 12 cuts to about 5.0° for 21 cuts.

In the setting of the present invention, relative to the prior art "miracle" setting, the changes in the number and configuration of the cuts 34 of the annulus 32 contribute to the simulation of the appearance of a larger diamond by increasing the number of cut walls or reflecting surfaces 36 and allowing them to be better defined even at the vertex so that they function to better reflect light. The changes in the number and disposition of the prongs 40 minimizes the interfering effect of the prongs 40 on the simulation of the appearance of a larger diamond by blocking fewer of the cuts 36 (three instead of four) and enabling a wider peripheral border of reflecting surface surrounding the diamond D.

The combination of increased effective reflecting surfaces by the cuts and decreased effective interference from the prongs with the reflecting surfaces enhances the efficacy of the prior art "miracle" setting so as to simulate the impression of a much larger diamond than is actually contained in the setting.

Many of the parameters of the setting are determined by the diamond D to be set therein—for example, the diameter of the annulus inner surface 42, the diameter of the annulus outer surface 44, the annulus maximum height, and the combined height of the annulus 32 and prong 40. By way of example, the diameter of the annulus inner surface may vary from 0.177" for a 0.5 point diamond to 0.085 for a 10 point diamond.

To summarize, the improved "miracle" diamond setting of the present invention varies the number, disposition, configuration and/or relative disposition of the cuts and prongs of a standard "miracle" setting to provide an improved setting which simulates the appearance of an even larger diamond than the conventional "miracle" setting.

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the invention herein.

I claim:

1. A generally round setting for a diamond which simulates the appearance of a larger diamond, comprising:

(A) reflecting means for reflecting light upwardly through the diamond, said reflecting means including an annulus having an inner surface, an outer surface spaced from said inner surface, and an upper surface stamped with at least nine equally spaced apart, radially extending cuts providing planar reflecting surfaces, each of said cuts being wedge shaped in plan and V-shaped in cross section, and (B) means upstanding from said annulus upper surface for receiving and holding the girdle of the diamond in a position spaced above said annulus upper surface, thereby to permit light to be reflected upwardly by said reflecting means through the diamond, including not more than three equally spaced apart prongs upstanding from said annulus upper surface.

2. The setting of claim 1 wherein each of said cuts has sidewalls which meet sharply at an angle of approximately 120°.

3. The setting of claim 2 wherein, for an annulus with N number of said cuts, said cuts are inclined upwardly at an angle of A° according to the formula $$A=[(360/N)/2]\times \tan\,30°.$$

4. The setting of claim 1 wherein, from the outer surface of said annulus inwardly towards the inner surface of said annulus, said cuts are inclined upwardly at an angle of approximately 5.0 to 8.5° to the horizontal, thereby becoming shallower nearer the center of the diamond.

5. The setting of claim 1 wherein, for an annulus having N number of said cuts, each inclined upwardly at an angle of A° from the outer surface to the inner surface of said annulus and having walls forming an angle of X°, $$A=[(360/N)/2]\times \tan\,[(180-X)/2].$$

6. The setting of claim 1 wherein said prongs are closer to the inner surface of said annulus than the outer surface.

7. The setting of claim 1 substantially formed of white gold.

8. The setting of claim 1 wherein said annulus has 9–21 of said cuts.

9. The setting of claim 8 wherein said annulus has 12–21 of said cuts.

10. The setting of claim 9 wherein said annulus has 12 of said cuts.

11. The setting of claim 1 wherein at least a portion of said reflecting means is disposed in vertical alignment with the diamond thereabove.

12. The setting of claim 1 wherein said receiving and holding means includes three and only three of said prongs.

13. The setting of claim 1 wherein said prongs are functional and configured and dimensioned to receive and hold the girdle of the diamond in a position spaced above said annulus upper surface.

* * * * *